US010577055B1

(12) United States Patent
Kirk

(10) Patent No.: US 10,577,055 B1
(45) Date of Patent: Mar. 3, 2020

(54) COLLAPSIBLE KAYAK

(71) Applicant: Rhys Kirk, West Lethbridge (CA)

(72) Inventor: Rhys Kirk, West Lethbridge (CA)

( * ) Notice: Subject to any disclaimer, the term of this patent is extended or adjusted under 35 U.S.C. 154(b) by 0 days.

(21) Appl. No.: 16/057,846

(22) Filed: Aug. 8, 2018

(51) Int. Cl.
*B63B 7/04* (2006.01)
*B63B 35/71* (2006.01)

(52) U.S. Cl.
CPC ..... *B63B 7/04* (2013.01); *B63B 35/71* (2013.01)

(58) Field of Classification Search
CPC .. B63B 7/00; B63B 7/04; B63B 35/71; B63B 79/16
USPC ..... 114/352
See application file for complete search history.

(56) References Cited

U.S. PATENT DOCUMENTS

| | | | | |
|---|---|---|---|---|
| 189,297 | A | 4/1877 | Bates | |
| 494,288 | A | 3/1893 | Clark | |
| 1,578,472 | A * | 3/1926 | Sawyer | B63B 7/04 114/352 |
| 2,494,763 | A * | 1/1950 | Jones | B63B 7/04 114/352 |
| 2,666,933 | A | 1/1954 | Engensperger | |
| 3,266,067 | A | 8/1966 | Windle | |
| 6,729,260 | B2 | 5/2004 | Elvestad | |
| 7,568,444 | B2 | 8/2009 | Espeseth et al. | |
| 7,963,243 | B2 | 6/2011 | Quigley | |
| 8,783,204 | B1 | 7/2014 | Herold | |
| 8,905,802 | B2 | 12/2014 | Ramelot et al. | |
| 2004/0011275 | A1 | 1/2004 | Broom | |
| 2008/0121166 | A1 | 5/2008 | Yaron et al. | |

FOREIGN PATENT DOCUMENTS

| | | | | |
|---|---|---|---|---|
| CH | 103809 A * | 3/1924 | ..... | B63B 7/00 |

* cited by examiner

*Primary Examiner* — Anthony D Wiest
(74) *Attorney, Agent, or Firm* — Lewellyn Law, PLLC; Stephen Lewellyn

(57) ABSTRACT

A collapsible water vessel has a center hull section, a first plurality of hull extensions longitudinally slidable through an opening at a first end of the center hull section between extended and collapsed positions, and a second plurality of hull extensions longitudinally slidable through an opening at a second end of the center hull section between extended and collapsed positions. When the first plurality of hull extensions are in the extended configuration, adjacent hull extensions thereof form a sealing contact therebetween and an inboard most hull extension thereof forms a sealing contact with the center hull section. And when the second plurality of hull extensions are in the extended configuration, adjacent hull extensions thereof form a sealing contact therebetween and an inboard most hull extension thereof forms a sealing contact with the center hull section.

4 Claims, 8 Drawing Sheets

COLLAPSIBLE KAYAK

FIELD OF THE INVENTION

The present invention relates generally to personal water vessels, and more particularly, relating to a collapsible kayak.

BACKGROUND OF THE INVENTION

Transporting and storing personal water vessels, such as kayaks and canoes can be difficult because of their substantial size. To solve this problem, several types of collapsible kayaks or canoes have been developed but have not produced satisfactory results. Accordingly, a need and a desire for a collapsible water vessel with an improved construction that provides for better transport and storage and provides for easier assembly and disassembly remains.

SUMMARY OF THE INVENTION

Embodiments of the present invention addresses this need by providing a collapsible water vessel, such as a kayak, for example, having a construction that permits the hull of the vessel to slidingly retract and extend between the collapsed and extended configurations.

In general, in one aspect, a collapsible water vessel has a center hull section, a first plurality of hull extensions longitudinally slidable through an opening at a first end of the center hull section between extended and collapsed positions, and a second plurality of hull extensions longitudinally slidable through an opening at a second end of the center hull section between extended and collapsed positions. When the first plurality of hull extensions are in the extended configuration, adjacent hull extensions thereof form a sealing contact therebetween and an inboard most hull extension thereof forms a sealing contact with the center hull section. And when the second plurality of hull extensions are in the extended configuration, adjacent hull extensions thereof form a sealing contact therebetween and an inboard most hull extension thereof forms a sealing contact with the center hull section.

In general, in another aspect, one or more tension spars extending from an outboard most hull extension of said first plurality of hull extensions and said center hull section and one or more tension spars extending from an outboard most hull extension of said second plurality of hull extensions.

There has thus been outlined, rather broadly, the more notable features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in several ways. Also, it is to be understood that the phraseology and terminology employed herein are for descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings.

DETAILED DESCRIPTION OF THE INVENTION

Figure 1:
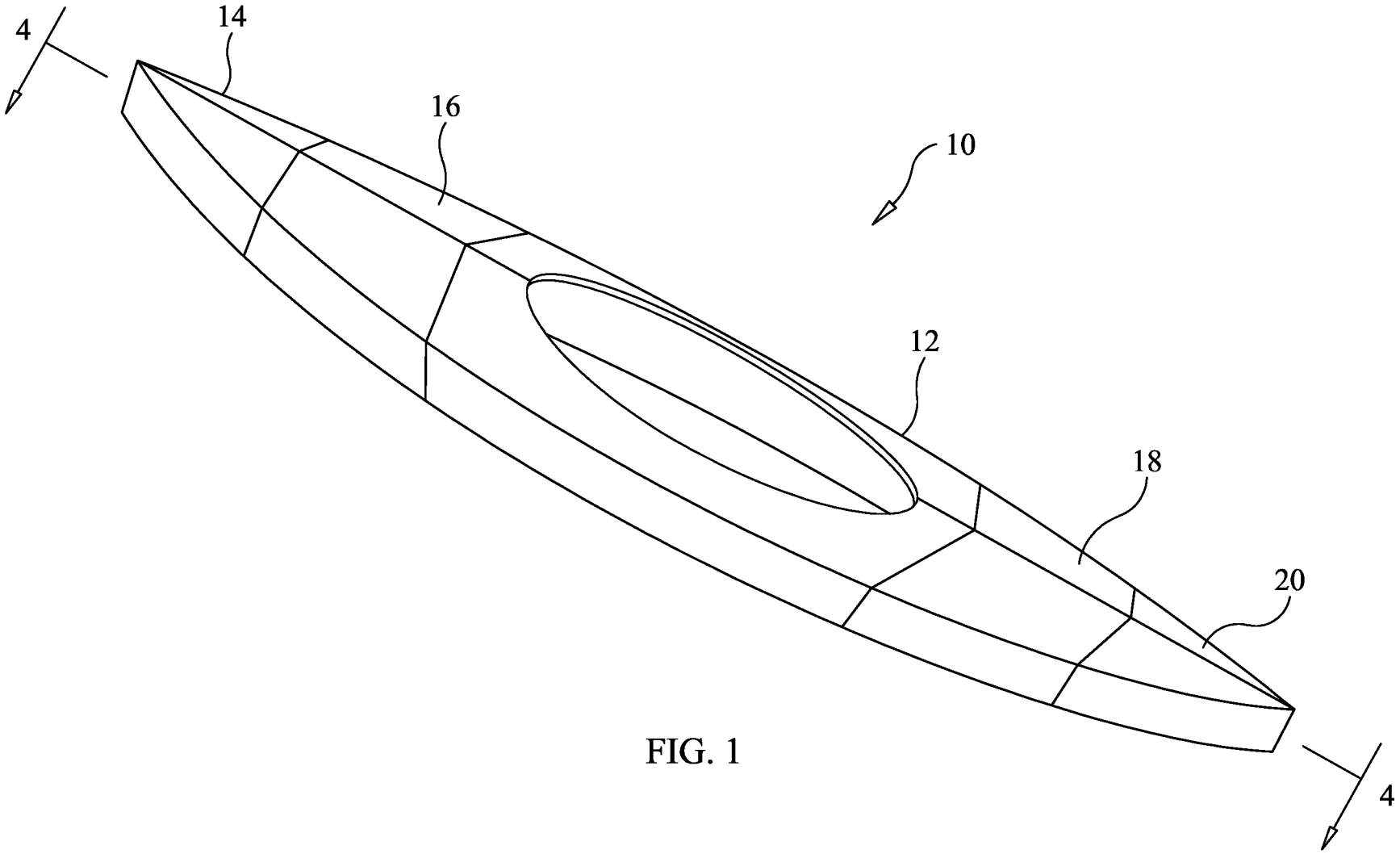
FIG. 1 is a perspective view of a collapsible kayak in accordance with an embodiment of the invention, shown in an extended, in-use configuration.
Figure 2:
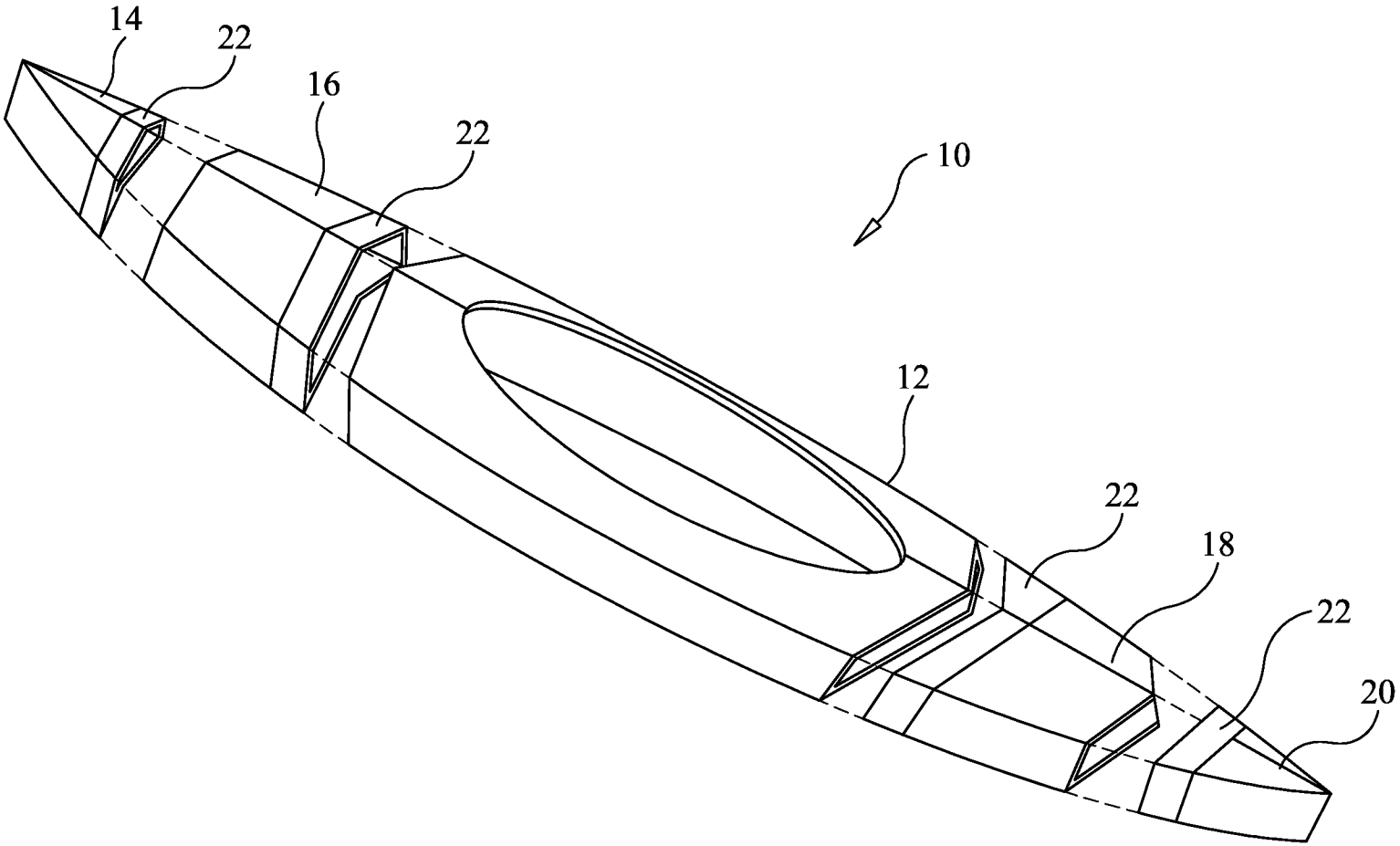
FIG. 2 is an exploded, perspective view of the collapsible kayak, showing the various hull sections.
Figure 3:
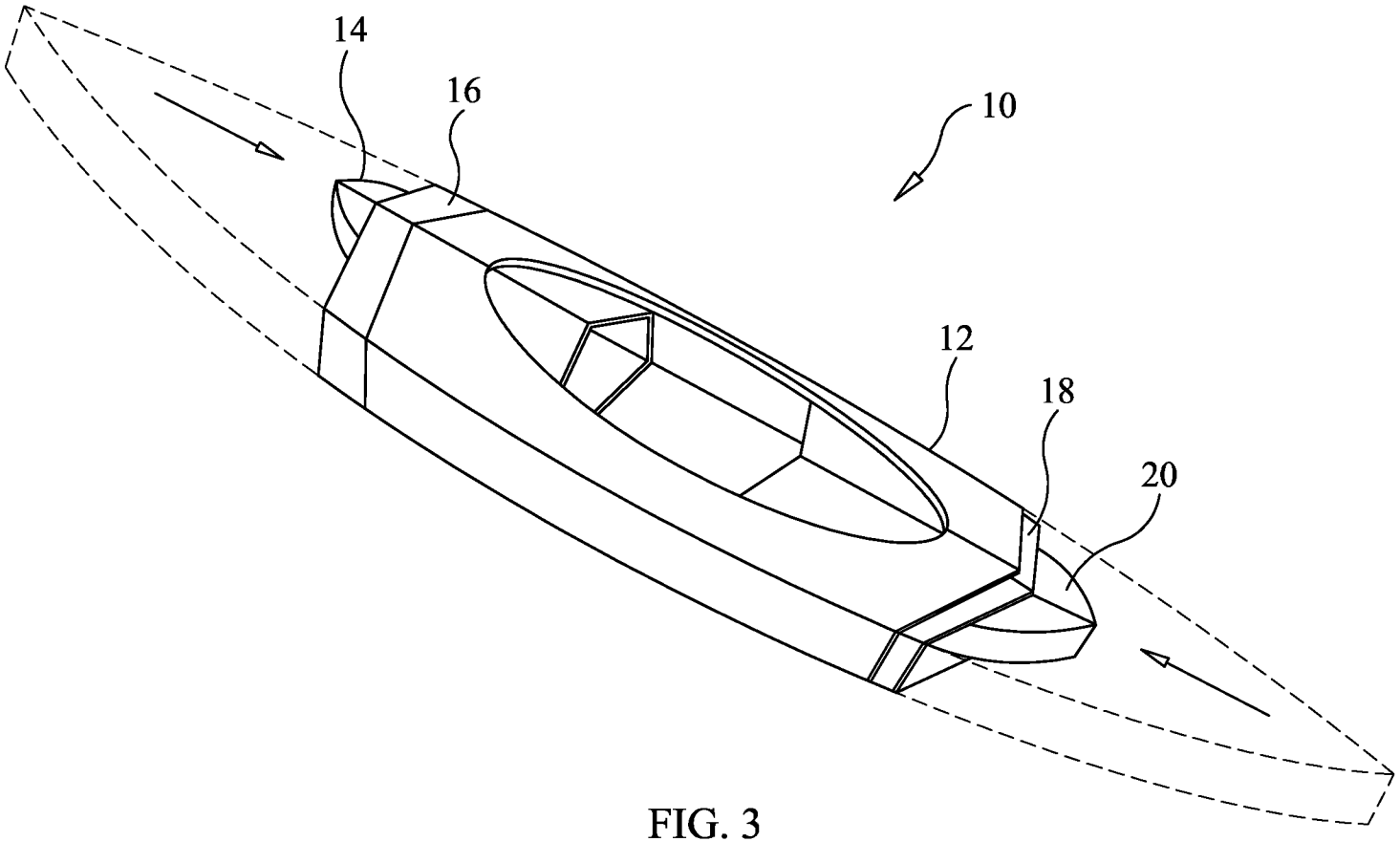
FIG. 3 is a perspective view of the collapsible kayak, shown in a partially collapsed configuration.

Referring to FIGS. 1-5, a collapsible kayak 10 according to the illustrated embodiment includes a multi-section hull having a center section 12 having a cockpit and a plurality of extension sections 14-20. Hull sections 12-20 are preferably made of a plastic material. The center section 12 and the extension sections 14-20 have progressively smaller cross-sectional profiles as the sections progress in the outboard direction. These progressively smaller cross-sectional profiles serve two purposes. First, they enable each of the extension sections 14-20 to nest within the adjacent inboard section in a collapsed configuration, as best seen in FIG. 3. And, second, they enable each of the sections to wedge against the adjacent outboard section in the extended configuration.

Figure 5:
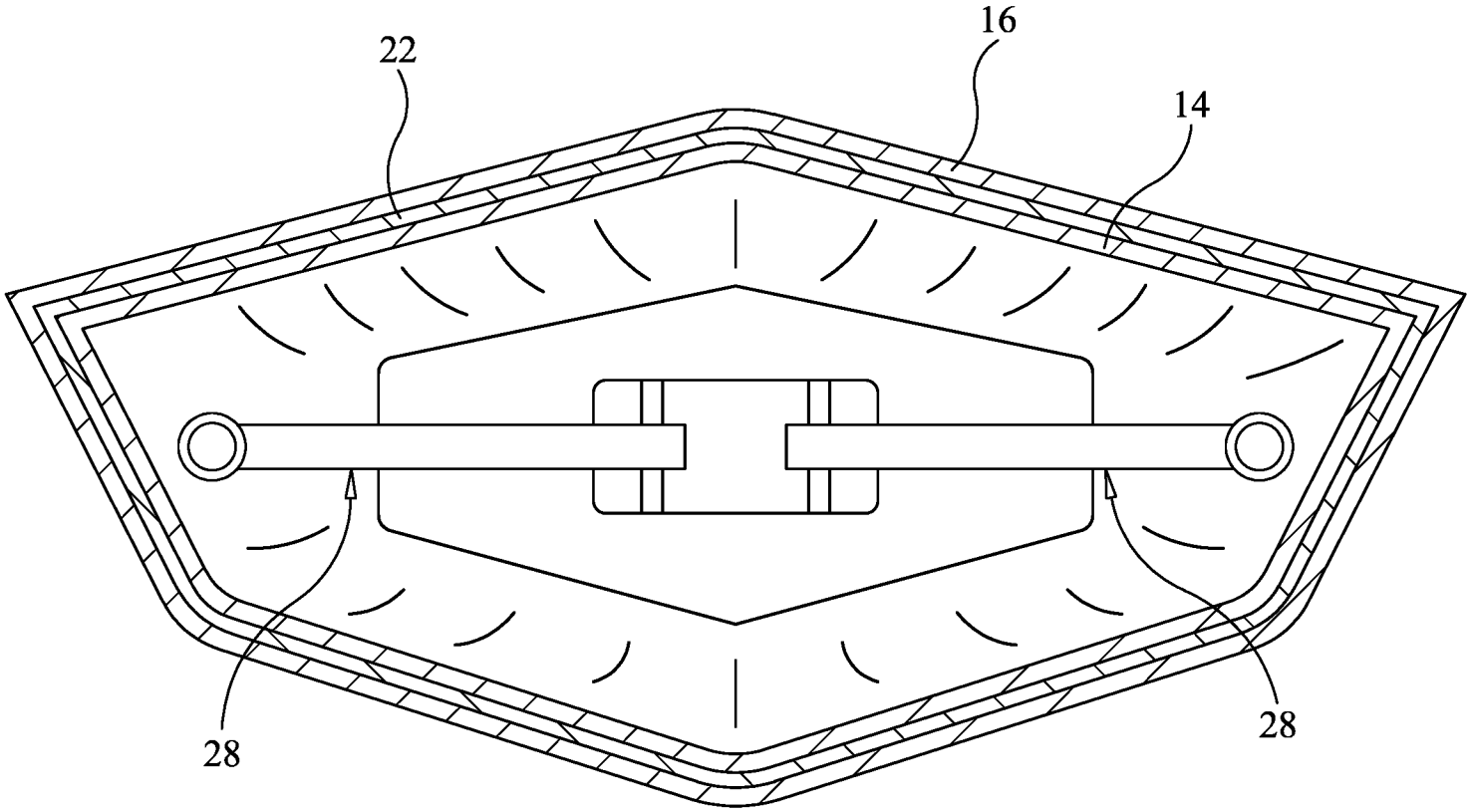
FIG. 5 is a cross-sectional view of the collapsible kayak then along line 5-5 in FIG. 4.

The wedging action provides structural integrity to the hull when in the extended configuration and provides a sealing contact between adjacent hull sections. Sealing contact between hull section is further provided by seals disposed between the hull sections that are compressed when the hull sections are extended and wedged together. In the representatively illustrated embodiment, a rubber seal 22 is attached to and encircles the inboard end of each extension section 14-20, as best seen in FIGS. 2 and 5.

In the representatively shown embodiment, the center section 12 has opposite open ends through which extension sections 16 and 18 extend. The openings in the ends of the center section 12 are configured and sized to prevent the inboard ends of sections 16 and 18 from passing through the openings. Extension 14 extends through the outboard end opening of extension 16 and that opening is configured and sized to prevent the inboard end of section 14 from passing through the outboard end opening of extension 16. And extension 20 extends through the outboard end opening of extension 18 and that opening is configured and sized to prevent the inboard end of section 20 from passing through the outboard end of extension 18.

Figure 6:
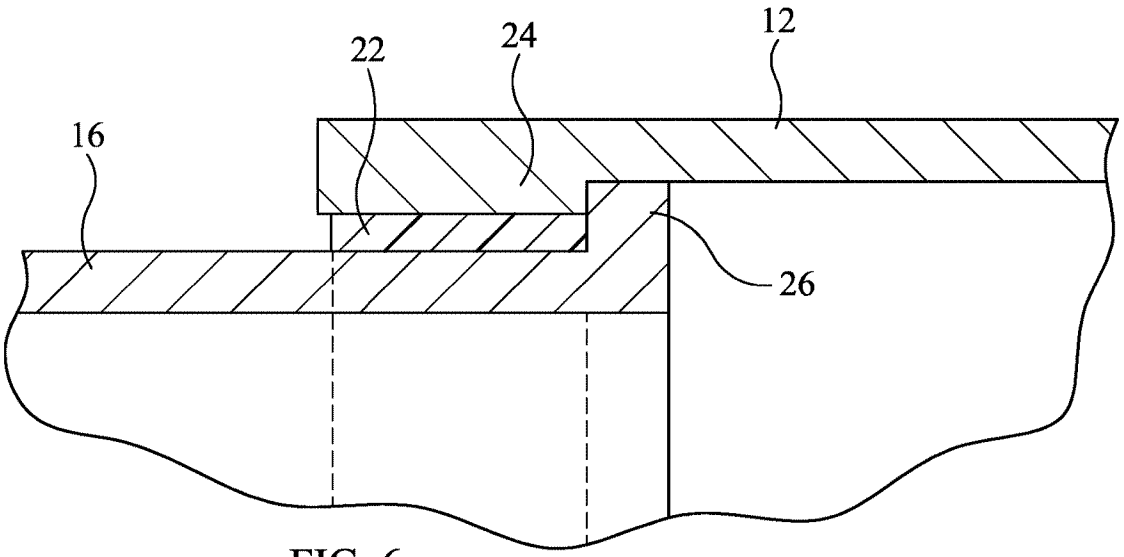
FIG. 6 is an enlarge, partial cross-sectional view taken through the ends of a center hull section and a hull extension section, showing an engagement therebetween and a sealing element.

For example, with reference to FIG. 6, the end opening of the center section 12 can be configured with a shoulder 24 that abuts a flange 26 that is disposed at the inboard end of extension 16, thereby preventing the inboard end of section 16 from passing through the opening. The opposite end opening of the center section 12 and the inboard end of section 18 is similarly configured. And, while not shown, the outboard and inboard ends of the remaining hull sections can be similarly formed to prevent passing through the openings as discussed above.

In a preferred embodiment, the lengths of extension sections 14-20 are sized so that in the collapsed configuration, the extension sections are substantially disposed within the center section 12. Accordingly, in the collapsed configuration, the kayak 10 can be conveniently and efficiently transported and stored. Further, it will be appreciated that while only four extension sections 14-20 are illustrated, additional or fewer sections can be used to create the telescopic hull configuration described herein.

Figure 4:
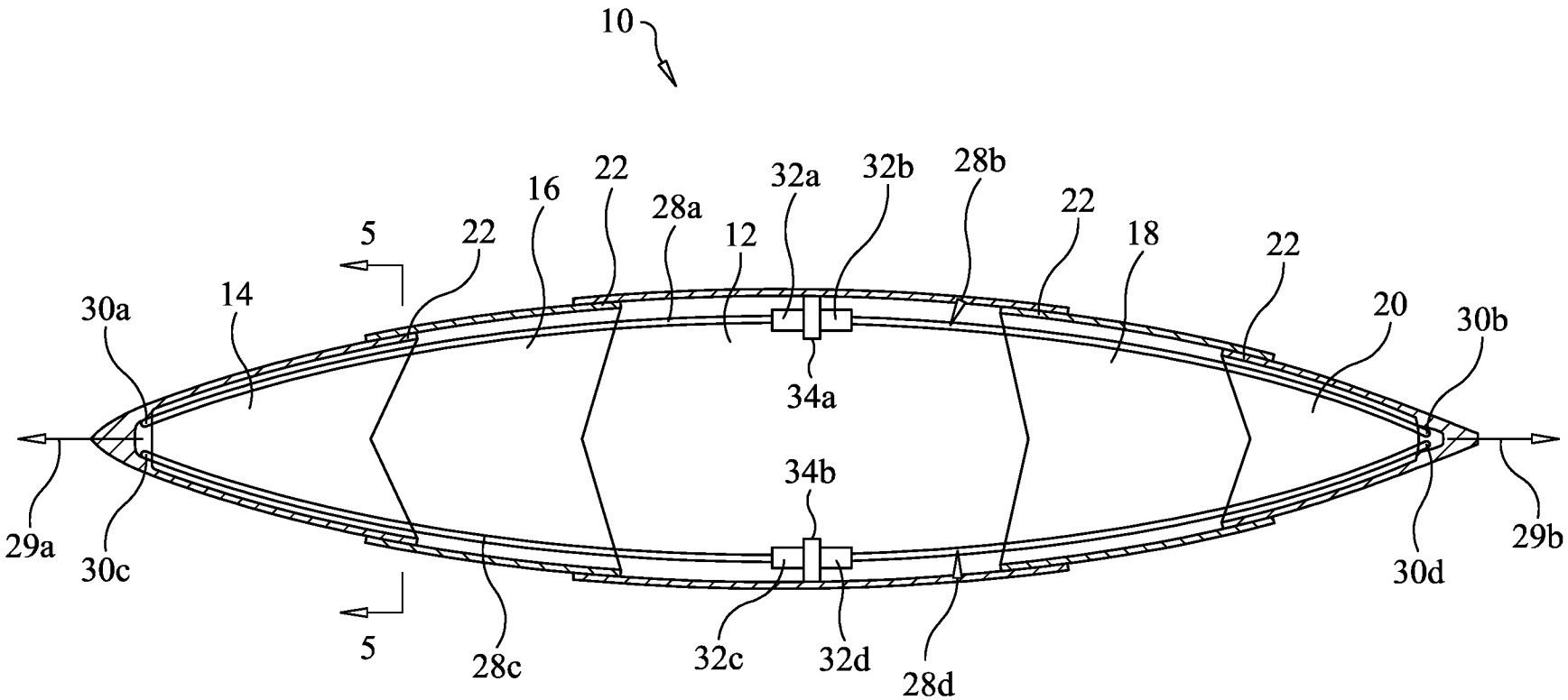
FIG. 4 is a cross-sectional view of the collapsible kayak taken along line 4-4 in FIG. 1.
Figure 7:
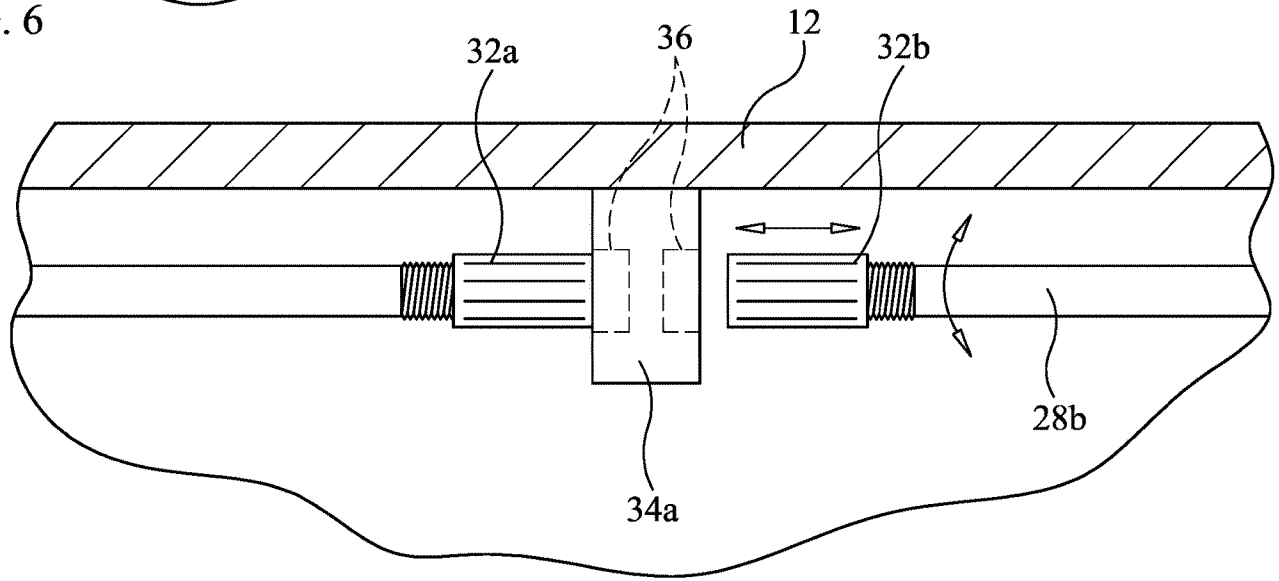
FIG. 7 is an enlarge, partial view of a pair of tension spars, showing an engagement with the center hull section.

With reference to FIGS. 4 and 7, one or more tension spars can be provided to hold the hull sections in the extended configuration. As shown, in the representative embodiment, four spars 28*a*-28*d* are located within the hull and extend through the hull sections and hold the sections in the extended configuration. Spars 28*a* and 28*c* are each pivotally attached at one end to the interior side of the bow hull extension 14 at pivots 30*a* and 30*c*, respectively. The opposite ends of spars 28*a* and 28*c* are removably engaged by brackets 34*a* and 34*b*, respectively, that are attached to opposite sides of the center section 12. Similarly, spars 28*b* and 28*d* are each are each pivotally attached at one end to the interior side of the stern hull extension 20 at pivots 30*b* and 30*d*, respectively. And the opposite ends of spars 28*b* and 28*d* are removably engaged by brackets 34*a* and 34*b*, respectively. Each spar 28*a*-28*d* is configured to apply a force 29*a* and 29*b* between the center hull section and the respective bow or stern section when engaged with the brackets, thereby securing the hull sections in the extended configuration. It should be noted that couplings 30*a*-30*d* could be ball-and-socket couplings allowing greater movement of each spar.

In an embodiment, each spar 28*a*-28*d* can comprises an elongated pole or bar having two or more sections that are telescopically connected and configured to extend and retract. The pole sections can be fitted with spring detents to secure the sections in the extended configuration and which can be pressed to allow the sections to collapse to the retracted configuration.

As further shown, in an embodiment, the ends of the spars opposite of the pivot couplings are each fitted with a threaded collar 32*a*-32*d*, respectively. As best seen in FIG. 7, bracket 34*a* has sockets 36 formed on opposite sides thereof into which the collars of the spars are removably received to engage the end of the spar with the bracket. Bracket 34*b* is similarly constructed. Turning the collar in a first direction lengthens the spar and provides tension in the spar and turning the collar in the opposite direction shortens and releases the tension in the spar and allows the spar the disengage the bracket.

Figure 8:
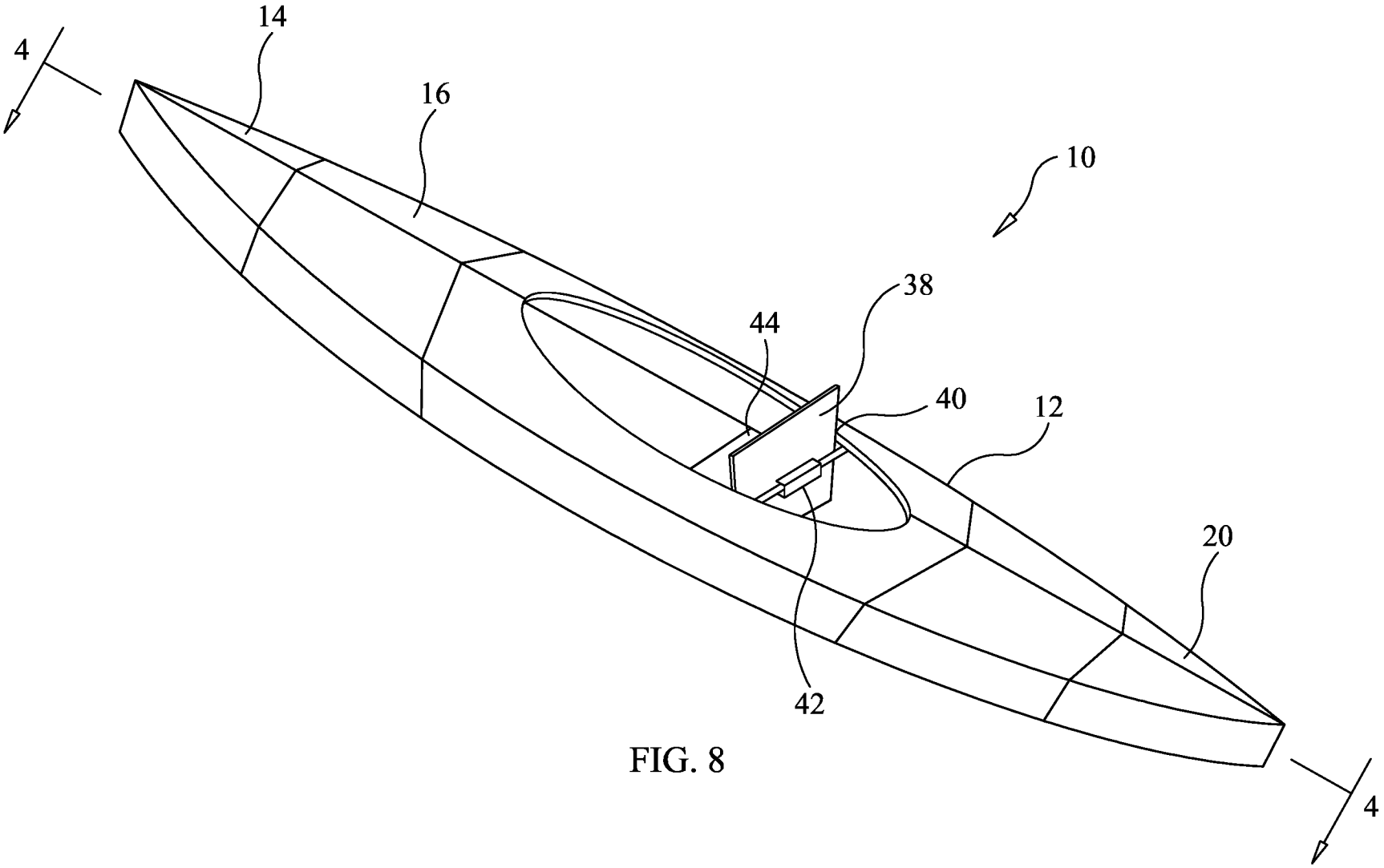
FIG. 8 is a perspective view of the kayak with a folding seat, shown with the kayak in the extended configuration.
Figure 9:
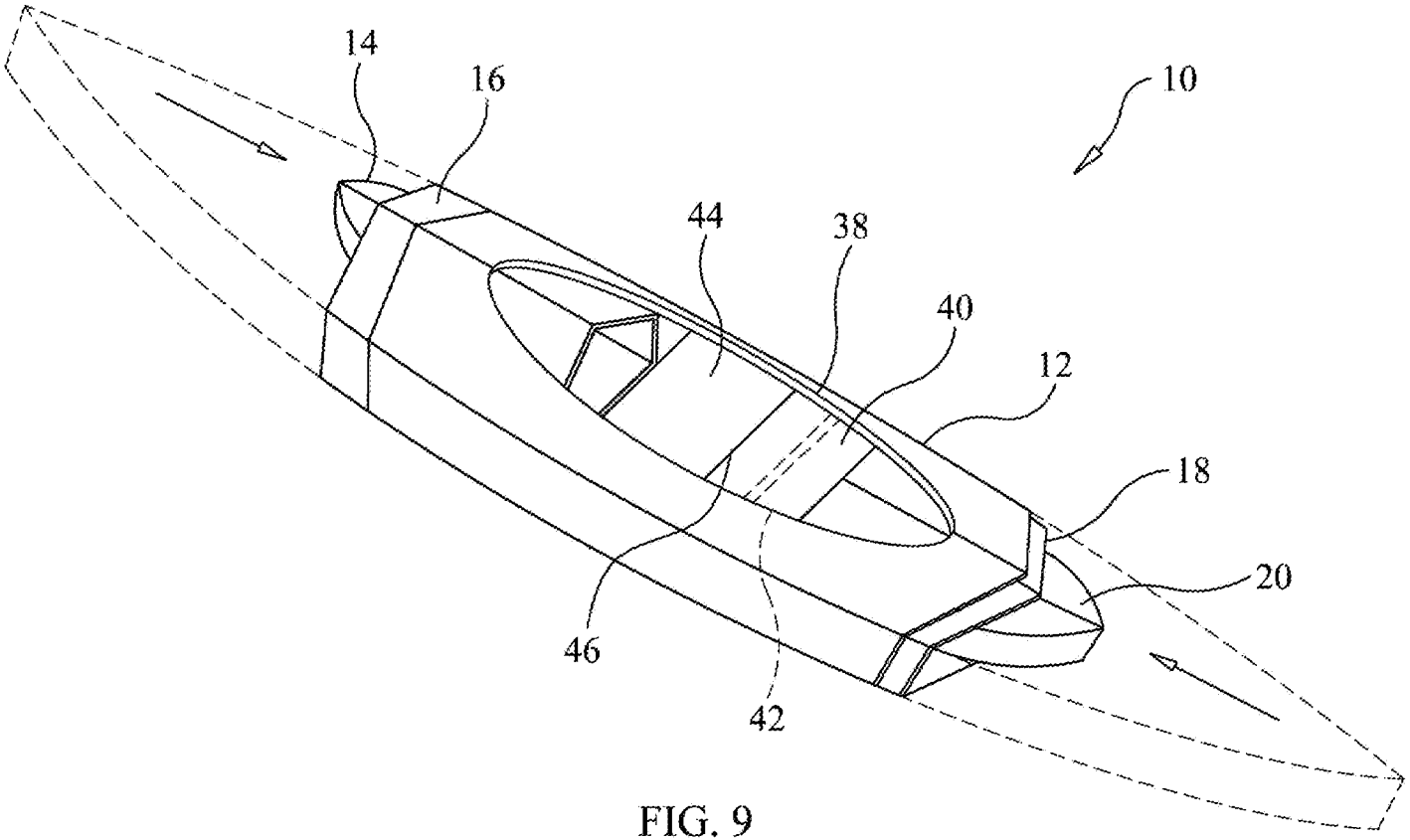
FIG. 9 is a perspective view of the kayak with a folding seat, shown with the kayak in the collapsed configuration.

With reference to FIGS. 8 and 9, kayak 10 can include a folding seat 38 attached to the center section 12 and disposed within the cockpit. The seat 38 has a backrest 40 that is pivotally connected to the center section, for example by pivot coupling 42 and a seat portion 44 that is hinged 46 to the bottom of the backrest. With the kayak 10 in the extend position, as shown in FIG. 8, the seat 38 unfolds into the cockpit. With the kayak 10 in the collapsed position, as shown in FIG. 9, the seat 38 folds upwardly and is disposed along the top of the center section 12, with the extension sections 14-20 disposed below the seat.

The representative embodiments of the invention disclosed herein are in the form of a single person kayak. However, the invention could be applied to various vessels such as, but not limited to a double kayak or canoe. It should also be appreciated that the invention is not limited to the specific hull shape illustrated in the drawings, and that hull could have other shapes. Also, as mentioned above, a greater or lesser number of hull extensions 14-20 may be used.

Several embodiments of the present invention have been described. Nevertheless, it will be understood that various modifications may be made without departing from the spirit and scope of the invention and the following claims.

What is claimed is:

1. A collapsible water vessel comprising:

a center hull section;

a first plurality of hull extensions longitudinally slidable through an opening at a first end of said center hull section between extended and collapsed positions;

a second plurality of hull extensions longitudinally slidable through an opening at a second end of said center hull section between extended and collapsed positions;

wherein when said first plurality of hull extension are in the extended configuration adjacent hull extensions thereof form a sealing contact therebetween and an inboard most hull extension thereof forms a sealing contact with said center hull section; and wherein when said second plurality of hull extension are in the extended configuration adjacent hull extensions thereof form a sealing contact therebetween and an inboard most hull extension thereof forms a sealing contact with said center hull section;

a first extensible tension spar attached at one end to an outboard most hull extension of said first plurality of hull extensions and connected at an opposite end to said center hull section;

a second extensible tension spar attached at one end to said outboard most hull extension of said first plurality of hull extensions and connected at an opposite end to said center hull section;

a third extensible tension spar attached at one end to an outboard most hull extension of said second plurality of hull extension and connected at an opposite end to said center hull section;

a fourth extensible tension spar attached at one end to an outboard most hull extension of said second plurality of hull extensions and connected at an opposite end to said center hull section;

said first and second extensible tension spars disposed along opposite sides of said first plurality of hull extensions, and when said first plurality of hull extension are in the extended position said first and second extensible tension spars are curved in opposite directions; and said third and fourth extensible tension spars disposed along opposite sides of said second plurality of hull extensions, and when said second plurality of hull extension are in the extended position said third and fourth extensible tension spars are curved in opposite directions.

2. The collapsible water vessel of claim 1 wherein the center hull section has an interior cross-sectional area that diminishes from a center thereof toward the openings, and the inboard ends of each hull extension of said first and second plurality of hull extensions has an opening and a greater outer cross-sectional area than an outboard end thereof.

3. The collapsible water vessel of claim 1 further comprising:

a seal encircling an inboard end of each hull extension of said first and said second plurality of hull sections.

4. The collapsible water vessel of claim 1, further comprising:

a first threaded collar attached to said first extensible tension spar and being rotatable in a first direction to apply tension in said first extendible tension spar;

a second threaded collar attached to said second extensible tension spar and being rotatable in a first direction to apply tension in said second extendible tension spar;

a third threaded collar attached to said third extensible tension spar and being rotatable in a first direction to apply tension in said third extendible tension spar; and a fourth threaded collar attached to said first extensible tension spar and being rotatable in a first direction to apply tension in said fourth extendible tension spar.

* * * * *